United States Patent [19]

Lewiner et al.

[11] Patent Number: 4,741,275

[45] Date of Patent: May 3, 1988

[54] DEVICE FOR CONTROLLING ACCESSES OF THE SECURITY CHAMBER

[76] Inventors: Jacques Lewiner, 5, rue Bory d'Arnex, 92210 Saint Cloud; Claude Hennion, 18, rue Flatters, 75005 Paris, both of France

[21] Appl. No.: 674,673

[22] Filed: Nov. 26, 1984

[30] Foreign Application Priority Data

Nov. 24, 1983 [FR] France ..... 83 18762

[51] Int. Cl.[4] ..... E05G 3/00

[52] U.S. Cl. ..... 109/7; 109/59 R; 70/278

[58] Field of Search ..... 109/6, 7, 59 R, 59 T; 70/256, 257, 278; 292/144

[56] References Cited

U.S. PATENT DOCUMENTS

| | | | |
|---|---|---|---|
| 3,100,389 | 8/1963 | Noregaard | 109/7 |
| 3,996,591 | 12/1976 | Hayward | 292/144 |
| 4,148,092 | 4/1979 | Martin | 70/278 |
| 4,232,354 | 11/1980 | Mueller et al. | 70/278 |
| 4,342,210 | 8/1982 | Denningham | 70/278 |
| 4,411,144 | 10/1983 | Aydin | 70/278 |
| 4,481,887 | 11/1984 | Urbano | 109/6 |

FOREIGN PATENT DOCUMENTS

| | | | |
|---|---|---|---|
| 2317542 | 11/1974 | Fed. Rep. of Germany | 109/7 |
| 2409364 | 7/1979 | France | 109/7 |
| 2514306 | 4/1983 | France | 70/256 |

*Primary Examiner*—Neill Wilson

*Attorney, Agent, or Firm*—Larson and Taylor

[57] ABSTRACT

The invention relates to devices for controlling accesses of the security chamber type which comprise at least two doors (2, 3). A single program selector (14, 15) with easy and instant control allows the security chamber operating program to be chosen at will from several predetermined programs.

9 Claims, 4 Drawing Sheets

FIG. 4.
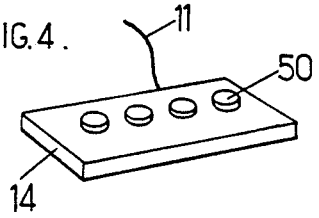
FIG. 5.
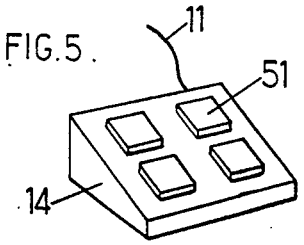
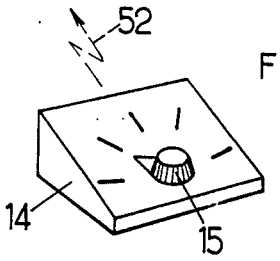
FIG. 6.

DEVICE FOR CONTROLLING ACCESSES OF THE SECURITY CHAMBER

The invention relates to devices for controlling accesses of the security chamber type comprising at least two doors each equipped with a lock with electrically controlled locking and a control device adapted to apply to said locks n separate operating programs, n being a whole number greater than 1.

Each program represents a particular combination. The components or elements of such a combination include: the rest states of the locks, each lock being able to be opened or closed at rest; and the capacities of these locks to change state, each lock being able to be controlled, for example, depending on the circumstances, from a gate keeper outside the security chamber, from a gate keeper inside the chamber, from a desk situated at a distance from a chamber, from a coded card reader or from a like controller or control source.

In access control devices of the kind in question known up to the present, the replacement of one program by another is achieved by actuating a certain number of electric switches or similar members grouped together on a control desk.

This arrangement has several disadvantages.

First it is relatively difficult to implement, considering the multiplicity of switches to be actuated and the need to choose, for each program change, those ones of these switches which are to be actuated.

Further, each program is totally cleared by the one which replaces it.

Now, there exist numerous situations in which it is important to be able to order a program change instantly, by a simple and single operation.

This is in particular the case in banks, post offices or other public places, in which action must be taken rapidly in the case of an aggression or catastrophe, for simultaneously locking the two doors of the security access chamber so as to lock an undesirable person therein, or for simultaneously unlocking the two doors of the security chamber so as to free the passage to the exit from the premises served by this chamber in the case of a fire, or for preventing any passage through the security chamber or for another similar purpose.

These emergency control possibilities must moreover exist side by side with more current control possibilities such as successive unlocking of the two doors of the chamber, the opening of each door only being made possible when the other door is closed more particularly for filtering the persons coming into the premises served by the security chamber, or for protecting the premises and its environment from special phenomena reigning on the other side of the chamber (light, pollution, pressure or depression, or the like.

Similarly, it may be useful to have several separate modes of controlling the locks of the doors of the security chamber depending on the circumstances, each lock being for example controlled during daytime by pressing a push button forming part of a gate keeper mounted on the casing of the corresponding door and at night by introducing a coded card into an appropriate reader.

The invention makes possible instantaneous and easy program changes of the kind in question, these changes requiring of the person who orders them neither concentration of mind nor consultation of special instructions.

In addition, the adoption of each program in no wise alters the previously adopted programs, which may all be again adopted by a single gesture.

For this, the control devices of the kind in question are essentially characterized in accordance with the invention in that they comprise a single n position selector with ready and rapid actuation, and electric means associated with this selector and adapted to automatically apply to the security chamber the n operating programs when this selector is placed respectively in its n positions.

In preferred embodiments, recourse is further had to one and/or the other of the following arrangements:

an arrangement wherein the selector is controlled by a rotary knob with n positions, one wherein the selector is controlled by n push buttons, one wherein the selector is controlled by a keyboard, and/or one wherein the electric means associated with this selector are adapted so as to provide wireless remote control.

The invention comprises, apart from these main arrangements, certain other arrangements which are preferably used at the same time and which will be more explicitly discussed hereafter.

In what follows a particular embodiment of the invention will be described with reference to the accompanying drawings in a way which is of course in no wise limitative.

FIG. 1, of these drawings, shows a perspective view of a security chamber and its control device constructed in accordance with the invention;

FIGS. 4, 4 and 6 are perspective views of alternate embodiments of the selector of FIG. 1.

Figure 1:
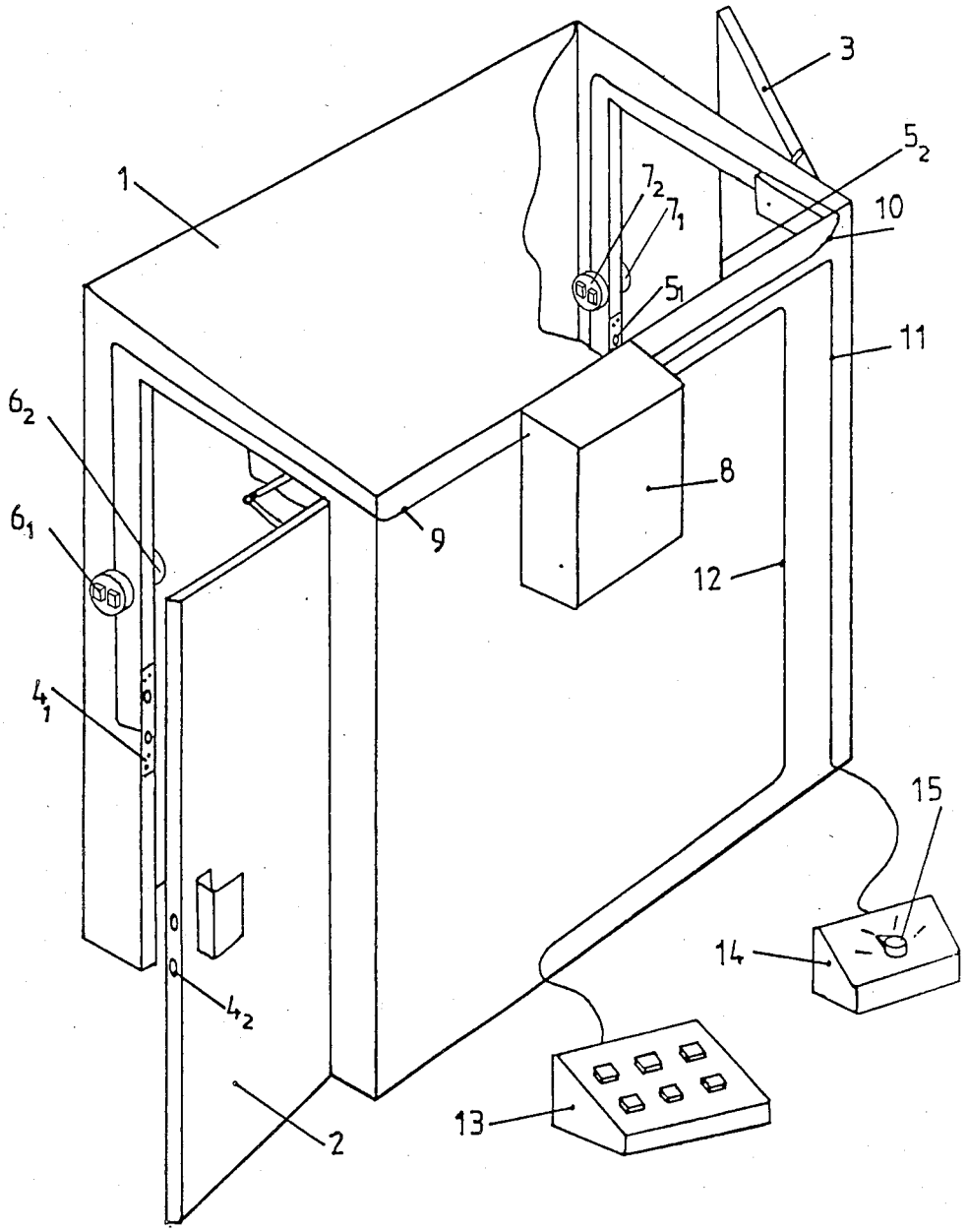

In FIG. 1, the security chamber is shown in perspective with two doors 2 and 3 on the casing of which are located two locks $4_1$ and $5_1$ adapted for cooperating with their respective striking boxes $4_2$ and $5_2$, "gate keepers" or control and signalling means $6_1$ and $6_2$ situated on each side of the door 2 and $7_1$ and $7_2$ situated on each side of door 3. A security chamber controller 8 is connected to lock $4_1$ and to the gate keepers $6_1$ and $6_2$ by an assembly of cables 9, to lock $5_1$ and to gate keepers $7_1$ and $7_2$ by an assembly of cables 10, to control desk 13 by a cable 12 and to a program selector 14 by cable 11.

The program selector 14, for selecting the desired operating program for the chamber, comprises a rotary switch 15.

Figure 2:
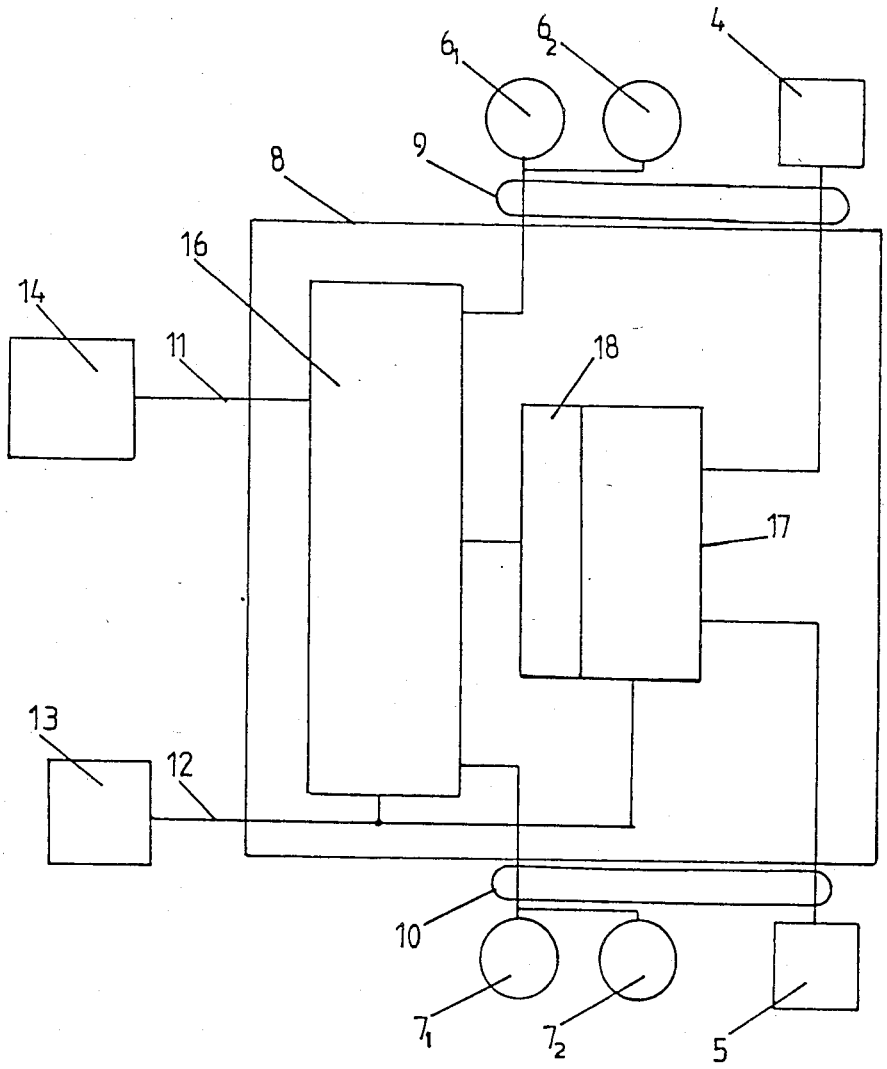
FIG. 2 is an electric diagram of this control device.

FIG. 2 shows schematically the security chamber controller 8 which comprises a programmer 16 for the different operating modes of the security chamber, connected to the inputs 18 of a logic processing unit 17. This unit manages the whole of the signals coming on the one hand from gate keepers $6_1$, $6_2$, $7_1$, $7_2$ and from the control desk 13 through the programmer 16 and, on the other hand, from locks 4, 5 and produces the electric signals for controlling the locks and signalling to the gate keepers and the control desk.

Figure 3:
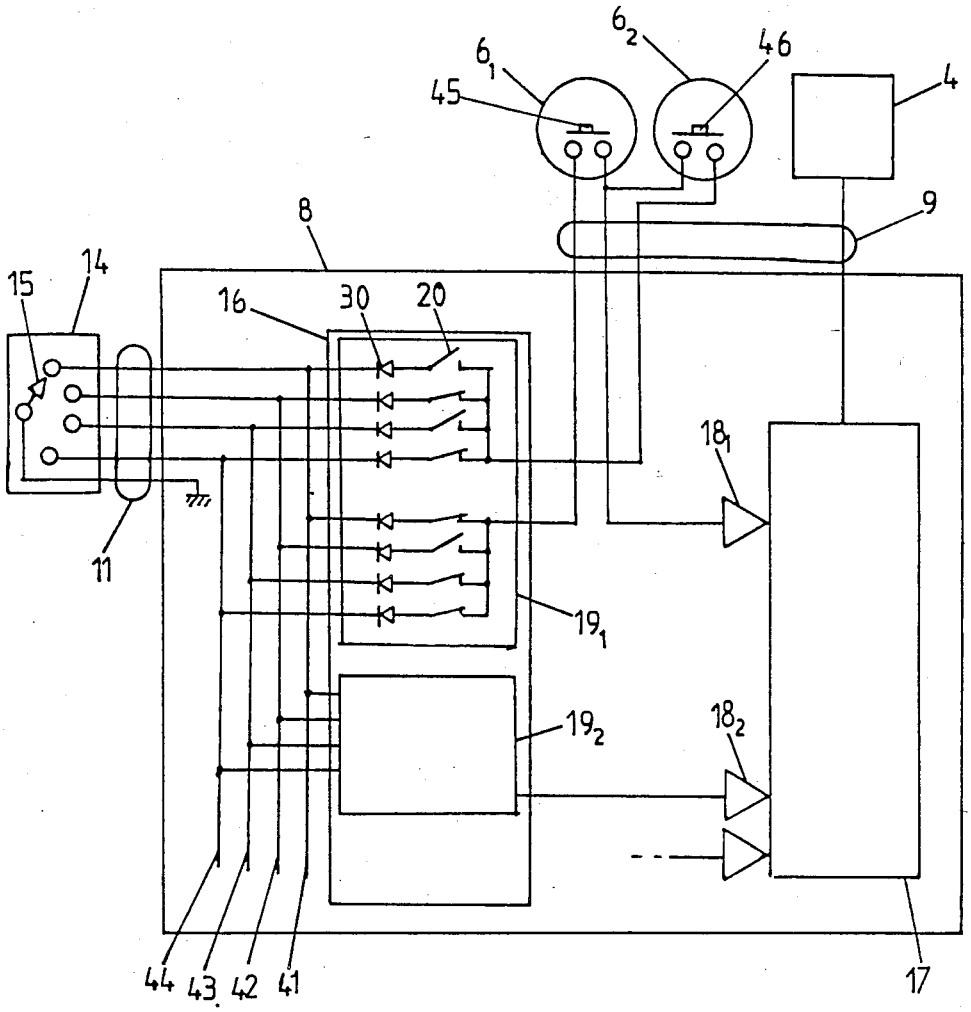
FIG. 3 is a more detailed electric diagram of a part of this device.

FIG. 3 shows a particular embodiment of the program selector 14 and of the programmer 16.

In this Figure, selector 14 is formed by a four position switch 15 allowing the choice between four programs.

These programs are elaborated in programmer 16 by switching means such as switches 20 connected in series with diodes 30 themselves connected so that each of the different positions of switch 15 actuates, among the electric conductors 41, 42, 43, 44 of cable 11, the one to which this contactor is connected, namely conductor 41 in FIG. 3.

Each of switches 20 is placed once and for all in its opened or closed position by the technician who installs the device, depending on the different programs which it is desired to assign to this device.

Each of the elements likely to be controlled, for example the means 45 for controlling opening of gate keeper $6_1$ (or the means 46 for controlling opening of gate keeper $6_2$) is connected on the one hand to one of the inputs $18_1$, $18_2$, etc of the processing unit 17 and, on the other hand, to one of the arrays $19_1$, $19_2$ of switches 20 and diodes 30, each of these arrays being itself connected to the conductors 41, 42, 43, and 44.

Such an arrangement allows as many different and independent configurations to be formed as there are effective positions of switch 15, and that for all the types of control means connected electrically to the processing unit such as those associated with the different gate keepers or with the desk.

The switching elements such as switch 15 and switches 20 may be formed in any suitable way for example by using ohmic contacts, semiconductor elements, optoelectronic couplers, relays, etc.

The connection means between selector 14 and the security chamber controller 8 have been shown in FIG. 1 by a cable 11.

These means may also be formed by an immaterial connection such as indicated in dashed lines at 52 in FIG. 6 using electromagnetic waves for example in the high frequency range, or infrared rays, or else modulated ultrasonic waves.

In each case, the presence of the selector provides a particularly convenient control of the security chamber and substantially increases its safety in use.

Thus, when a person responsible for the safety of a premises desires, following an unforseen situation, to change the operating mode of the security chamber which controls access to these premises, it is sufficient to operate selector 14.

As is evident and as it follows moreover already from what has gone before, the invention is in no wise limited to these modes of application and embodiments which have been more especially considered; it embraces, on the contrary, all variants thereof.

In particular, the selector 14 could be controlled by an element 15 easy to actuate other than a rotary switch with n positions (n being a whole number greater than 3 and equal to the number of programs), for example by a succession of n push buttons 50 (FIG. 4) assigned respectively to the n programs, or else by means of a keyboard 51 (FIG. 5) lending itself to the composition of n key combinations corresponding respectively to said n programs.

Similarly, coding means may be provided at the level of the selector so that only a responsible person knowing the authorized code may select the programs These means may be either immaterial coding means such as the composition of a secret code, or material means such as positioning a coded mechanical key in the selector.

The different programs preestablished in the programmer 16 may also be formed not by positioning electric contactors but by a set of logic data, for example binary data, stored in a memory, such as a fusible type memory, or else a semiconductor memory, this set of logic data being if required used by a calculator: in this latter case, putting the selector to its different position indicates to the calculator the region in the memory where the program to be executed is to be found, or else the instructions to be executed for carrying out said program.

We claim:

1. A device for controlling an access of the security chamber type, comprising at least two doors each equipped with a lock with electrically controlled locking and a control device for applying to the security chamber n separate operating programs, where n is a finite whole number greater than 3, said programs including a program providing simultaneous locking of the two doors, a program providing simultaneous unlocking of the two doors according to at least two respective predetermined control modes, a program providing successive unlocking of the two doors according to at least two respective predetermined control modes, and at least one further program wherein a different control mode is provided for unlocking at least one of said doors, said device further comprising a single n position selector capable of easy and rapid actuation, and electric means, associated with said selector, for automatically applying to the security chamber an individual program of the n operating programs when the selector is placed in the position among its n positions which correspond to that program.

2. Control device according to claim 1, characterized in that the selector is controlled by means of a rotary knob with n positions.

3. Control device according to claim 1, characterized in that the selector is controlled by n push buttons.

4. Control device according to claim 1, characterized in that the selector is controlled by a keyboard with keys.

5. Control device according to claim 1, characterized in that the electric means associated with the selector includes means for providing wireless remote control.

6. Control device according to claim 1, characterized in that the electric means associated with the selector comprise a set of programs formed by a plurality of switches preset to their open or closed position, and associated with diodes.

7. Control device according to claim 1, characterized in that the electric means associated with the selector comprise a set of programs formed by a memory.

8. Control device according to claim 7, characterized in that the memory comprises a semiconductor memory associated with a computer able to use its contents according to the indications given by the selector.

9. Control device according to claim 1, characterized in that the selector is associated with coded safety means for allowing only the holders of a code to control the selector.

* * * * *